US010644455B1

(12) United States Patent
Champion

(10) Patent No.: US 10,644,455 B1
(45) Date of Patent: May 5, 2020

(54) ELECTRICAL CONNECTOR WITH ABSORBER MEMBER

(71) Applicant: TE CONNECTIVITY CORPORATION, Berwyn, PA (US)

(72) Inventor: Bruce Allen Champion, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/250,401

(22) Filed: Jan. 17, 2019

(51) Int. Cl.

| | |
|---|---|
| ***H01R 13/64*** | (2006.01) |
| ***H01R 13/6471*** | (2011.01) |
| ***H01R 12/72*** | (2011.01) |
| ***H01R 13/514*** | (2006.01) |
| ***H01R 13/6599*** | (2011.01) |
| ***H01R 13/516*** | (2006.01) |
| ***H01R 13/6587*** | (2011.01) |

(52) U.S. Cl.
CPC ..... *H01R 13/6471* (2013.01); *H01R 12/724* (2013.01); *H01R 12/727* (2013.01); *H01R 13/514* (2013.01); *H01R 13/516* (2013.01); *H01R 13/6587* (2013.01); *H01R 13/6599* (2013.01)

(58) Field of Classification Search
CPC ..... H01R 13/6471; H01R 12/721
See application file for complete search history.

(56) References Cited

U.S. PATENT DOCUMENTS

| | | | | |
|---|---|---|---|---|
| 6,709,294 | B1 | 3/2004 | Cohen et al. | |
| 7,163,421 | B1 | 1/2007 | Cohen et al. | |
| 8,083,553 | B2 | 12/2011 | Manter et al. | |
| 8,142,207 | B1 * | 3/2012 | Ljubijankic | H01R 13/6583 439/95 |
| 8,177,564 | B1 * | 5/2012 | Ito | H01R 13/6471 439/108 |
| 8,221,139 | B2 * | 7/2012 | Qin | H01R 31/08 439/92 |
| 8,523,583 | B2 * | 9/2013 | Ito | H01R 12/721 439/108 |
| 8,764,460 | B2 * | 7/2014 | Smink | H01R 13/6597 439/92 |
| 8,764,464 | B2 * | 7/2014 | Buck | H01R 13/514 439/108 |
| 8,764,488 | B2 * | 7/2014 | Zeng | H01R 13/6585 439/108 |
| 9,337,585 | B1 * | 5/2016 | Yang | H01R 13/6583 |
| 9,401,570 | B2 * | 7/2016 | Phillips | H01R 13/6585 |
| 9,431,768 | B1 * | 8/2016 | Champion | H01R 13/6471 |

(Continued)

*Primary Examiner* — Ross N Gushi

(57) ABSTRACT

An electrical connector includes a contact organizer, signal and ground contacts, and an absorber member. The contact organizer has a mating end, and includes a first wall and a second wall that define a card cavity therebetween. The card cavity is open at the mating end to receive a mating circuit card therein. The signal contacts and the ground contacts are held by the contact organizer along at least the first wall. The absorber member is mounted to the first wall of the contact organizer at the mating end. The absorber member includes at least one limb composed of a lossy material. Each limb projects into the card cavity and aligns with a corresponding one of the ground contacts. Each limb is configured to electrically connect to a corresponding ground pad of the mating circuit card.

20 Claims, 6 Drawing Sheets

(56) References Cited

U.S. PATENT DOCUMENTS

| | | | | |
|---|---|---|---|---|
| 9,455,530 | B2 * | 9/2016 | Patel | H01R 13/652 |
| 9,472,900 | B1 | 10/2016 | Phillips et al. | |
| 9,490,587 | B1 * | 11/2016 | Phillips | H01R 13/6587 |
| 9,520,680 | B2 * | 12/2016 | Hsu | H01R 13/658 |
| 9,531,129 | B2 * | 12/2016 | de Boer | H01R 13/6471 |
| 9,531,130 | B1 * | 12/2016 | Phillips | H01R 13/6471 |
| 9,640,915 | B2 * | 5/2017 | Phillips | H01R 13/6471 |
| 9,666,990 | B1 * | 5/2017 | de Boer | H01R 13/6471 |
| 9,666,998 | B1 | 5/2017 | de Boer et al. | |
| 9,692,183 | B2 * | 6/2017 | Phillips | H01R 13/6471 |
| 9,705,218 | B2 * | 7/2017 | Ito | H01R 12/721 |
| 9,748,681 | B1 | 8/2017 | Champion et al. | |
| 9,768,557 | B2 * | 9/2017 | Phillips | H01R 13/6585 |
| 9,859,635 | B1 | 1/2018 | Pickel et al. | |
| 9,859,656 | B2 | 1/2018 | Champion et al. | |
| 9,859,658 | B2 * | 1/2018 | Champion | H01R 13/6471 |
| 9,871,325 | B2 * | 1/2018 | Patel | H01R 13/6473 |
| 9,881,650 | B1 * | 1/2018 | Sotome | G11B 33/122 |
| 10,050,386 | B1 * | 8/2018 | Pickel | H01R 13/6473 |
| 10,128,620 | B1 * | 11/2018 | Wu | H01R 13/6585 |
| 10,135,197 | B2 * | 11/2018 | Little | H01R 12/58 |
| 10,243,289 | B2 * | 3/2019 | Sunaga | H01R 12/7082 |
| 10,243,304 | B2 * | 3/2019 | Kirk | H01R 13/6473 |
| 10,355,420 | B1 * | 7/2019 | Orris | H01R 13/6587 |
| 2009/0221165 | A1 * | 9/2009 | Buck | H01R 13/514 439/108 |
| 2013/0309906 | A1 * | 11/2013 | De Geest | H01R 13/6477 439/607.31 |
| 2014/0127946 | A1 * | 5/2014 | Ito | H01R 13/6599 439/629 |
| 2015/0255904 | A1 * | 9/2015 | Ito | H01R 12/721 439/88 |
| 2019/0207327 | A1 * | 7/2019 | Huang | H01R 4/02 |
| 2019/0214756 | A1 * | 7/2019 | Tracy | H01R 12/73 |
| 2019/0221973 | A1 * | 7/2019 | Kirk | H01R 13/6585 |

* cited by examiner

ELECTRICAL CONNECTOR WITH ABSORBER MEMBER

BACKGROUND OF THE INVENTION

The subject matter herein relates generally to high speed electrical connectors.

Electrical connector systems typically experience electrical interference, such as cross-talk and resonant frequency noise, at or around a mating zone where two electrical connectors electrically engage each other, particularly at high signal transmission frequencies (e.g., greater than 15 or 20 GHz). For example, high speed connectors may exhibit resonance spikes within the mating zone at certain frequencies. The resonance spikes may interfere with and degrade signal transmission between the connectors. To improve performance by reducing the electrical interference in the mating zone, Some known electrical connectors attempt to reduce electrical interference by including metal tie bars that electrically connect grounding contacts and/or other grounding elements together within the electrical connector. The metal tie bars may desirably reduce low frequency resonances within the electrical connector, such as in the frequency range below 15 GHz, but are often impractical to implement for resonances occurring at frequencies greater than 15 GHz. These higher frequency resonances may be caused by features in the mating zone.

A need remains for an electrical connector that effectively mitigates high frequency resonances in the mating zone.

BRIEF DESCRIPTION OF THE INVENTION

In one or more embodiments, an electrical connector is provided that includes a contact organizer, signal contacts and ground contacts, and an absorber member. The contact organizer has a mating end, and includes a first wall and a second wall that define a card cavity between respective inner surfaces of the first and second walls. The card cavity is open at the mating end to receive a mating circuit card therein. The signal contacts and the ground contacts are held by the contact organizer along at least the first wall. The absorber member is mounted to the first wall of the contact organizer at the mating end. The absorber member includes at least one limb composed of a lossy material. Each limb projects beyond the inner surface of the first wall into the card cavity and aligns with a corresponding one of the ground contacts. Each limb is configured to electrically connect to a corresponding ground pad of the mating circuit card.

In one or more embodiments, an electrical connector is provided that includes a contact organizer, signal contacts and ground contacts, and an absorber member. The contact organizer has a mating end, and includes a first wall and a second wall that define a card cavity between respective inner surfaces of the first and second walls. The card cavity is open at the mating end to receive a mating circuit card therein. The signal contacts and the ground contacts are held by the contact organizer along at least the first wall. The absorber member is mounted to the first wall of the contact organizer at the mating end. The absorber member is composed of a lossy material having a greater electric loss tangent or magnetic loss tangent than the contact organizer. The absorber member includes a crossbar that extends a length along the first wall and multiple limbs that extend from the crossbar at spaced apart locations along the length thereof. Each limb of the multiple limbs projects beyond the inner surface of the first wall into the card cavity and aligns with a corresponding one of the ground contacts. The multiple limbs are configured to electrically connect to different corresponding ground pads of the mating circuit card when the mating circuit card is received within the card cavity.

In one or more embodiments, an electrical connector is provided that includes a contact organizer, signal contacts and ground contacts, a first absorber member, and a second absorber member. The contact organizer extends along a mating axis from a mating end to a back end. The contact organizer includes a first wall and a second wall that define a card cavity between respective inner surfaces of the first and second walls. The card cavity is open at the mating end to receive a mating circuit card therein. The signal contacts and the ground contacts are held by the contact organizer along both the first wall and the second wall. The signal contacts are arranged in pairs. Adjacent pairs of the signal contacts are separated from each other by at least one of the ground contacts. The first absorber member is mounted to the first wall of the contact organizer at the mating end. The second absorber member is mounted to the second wall of the contact organizer at the mating end. The first and second absorber members are composed of a lossy material. Each of the first and second absorber members includes at least one limb that projects into the card cavity and aligns with a corresponding one of the ground contacts. Each limb of the first and second absorber members is axially spaced apart along the mating axis from the corresponding ground contact that aligns with the limb such that the limb is located closer to the mating end of the contact organizer than the corresponding ground contact. Each limb of the first and second absorber members is configured to physically engage and electrically connect to a corresponding ground pad of the mating circuit card when the mating circuit card is received within the card cavity to define a first connection point which is axially spaced apart from a second connection point defined by physical engagement between the same ground pad and the corresponding ground contact that aligns with the limb.

DETAILED DESCRIPTION OF THE INVENTION

Figure 1:
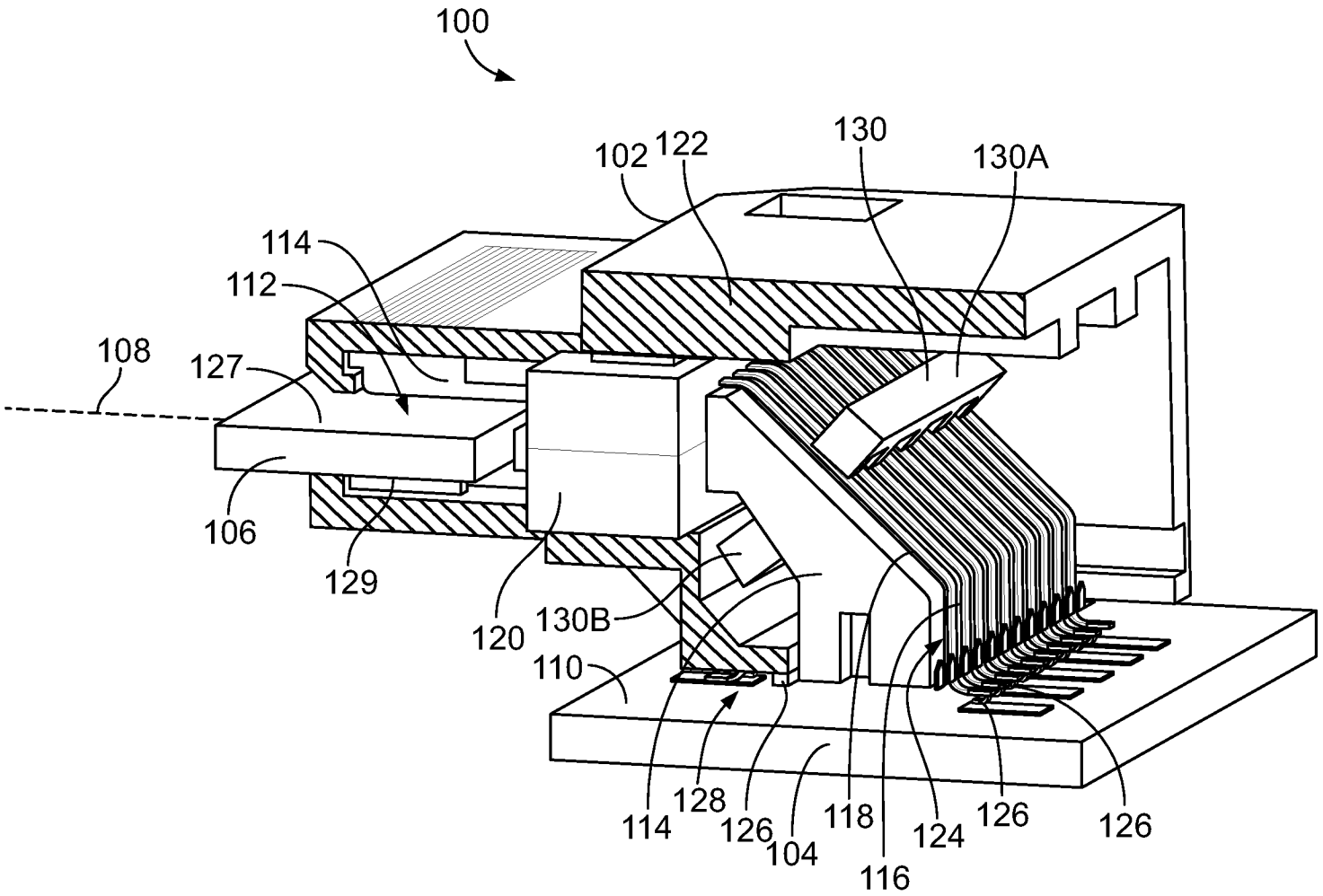
FIG. 1 is a perspective view of a connector system according to an embodiment.

FIG. 1 is a perspective view of a connector system 100 according to an embodiment. The connector system 100 includes an electrical connector 102, a host circuit board 104, and a mating circuit card 106. The electrical connector 102 is mounted to the host circuit board 104. The electrical connector 102 is removably coupled to the mating circuit card 106 to provide an electrical signal path that extends from the mating circuit card 106 through the electrical connector 102 to the host circuit board 104. The electrical connector 102 and mating circuit card 106 may be high speed connectors that transmit electrical signals at high data transfer speeds, such as at least 15 Gb/s, at least 20 Gb/s, at least 25 Gb/s, at least 30 Gb/s, or the like. The electrical signals may represent data, control signals, or the like. The mating circuit card 106 may be a component of a larger mating connector, such as an input/output (I/O) transceiver module connector.

In the illustrated embodiment, the electrical connector 102 is a right angle style board-mount connector because the electrical connector 102 receives the mating circuit card 106 along a mating axis 108 that is parallel to a top surface 110 of the host circuit board 104. Alternatively, the electrical connector 102 may be a vertical board-mount connector such that the mating circuit card 106 is received along a mating axis that is perpendicular (or otherwise transverse) to the top surface 110 of the circuit board 104. In alternative embodiments, the electrical connector 102 may be a cable-mounted connector, or the like. The electrical connector 102 defines a card cavity 112, and the mating circuit card 106 is insertable into the card cavity 112 to electrically connect the mating circuit card 106 and the electrical connector 102.

Figure 3:
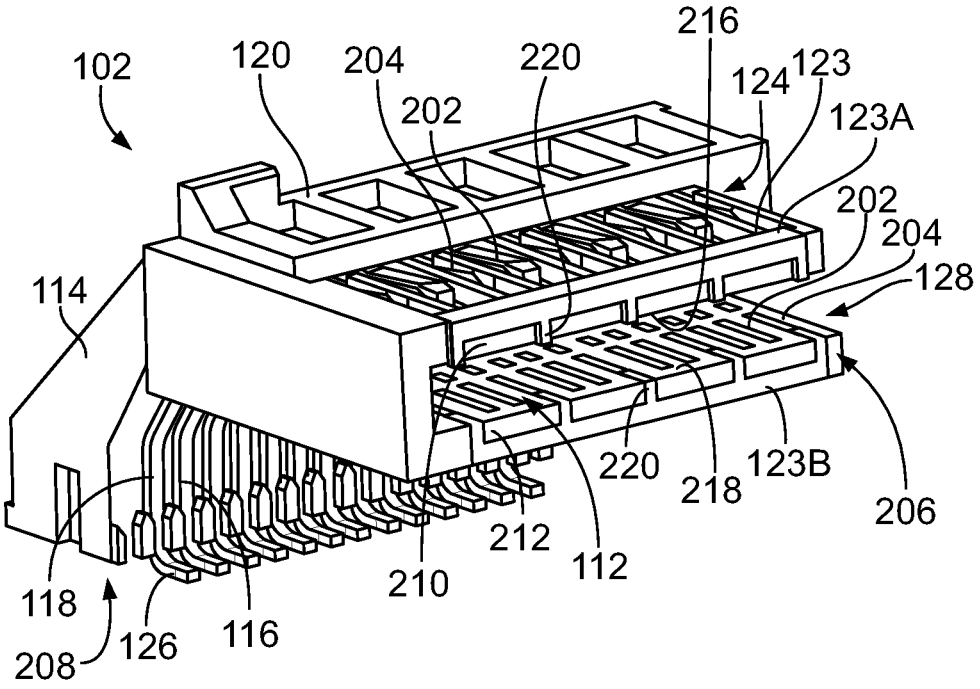
FIG. 3 is a perspective view of the electrical connector shown in FIG. 2 with an outer shell thereof omitted.

The electrical connector 102 in the illustrated embodiment includes a contact organizer 114, signal conductors 116, ground conductors 118, a dielectric holder 120, an outer shell 122, at least one ground tie bar 130, and at least one absorber member 123 (shown in FIG. 3). The outer shell 122 is a housing that surrounds the various components of the electrical connector 102. The outer shell 122 is shown in cross-section in FIG. 1 to enable viewing of the components within the outer shell 122. The signal conductors 116 and the ground conductors 118 are arranged side by side in two arrays or rows. The signal conductors 116 are interspersed with the ground conductors 118 in each row. The signal conductors 116 and ground conductors 118 have tails 126 at one end that are electrically connected to the host circuit board 104. For example, the tails 126 may be soldered to respective signal and ground pads of the host circuit board 104. Alternatively, the tails 126 may be through-hole mounted into vias of the circuit board 104.

At the end opposite the tail 126, each of the signal conductors 116 and the ground conductors 118 defines a contact for electrically connecting to the mating circuit card 106. For example, the signal conductors 116 define signal contacts 202 (shown in FIG. 3), and the ground conductors 118 define ground contacts 204 (FIG. 3). The signal contacts 202 and ground contacts 204 of the signal and ground conductors 116, 118 in a first row 124 of the two rows are configured to engage corresponding pads along a first side 127 of the mating circuit card 106. The signal contacts 202 and ground contacts 204 of the signal and ground conductors 116, 118 in a second row 128 are configured to engage corresponding pads along an opposite, second side 129 of the mating circuit card 106.

The contact organizer 114 and the dielectric holder 120 secure the signal and ground conductors 116, 118 in fixed positions. In an embodiment, the dielectric holder 120 is overmolded around the signal and ground conductors 116, 118 in each row. The dielectric holder 120 may have a first discrete portion that is overmolded around the conductors 116, 118 in the first row 124 and a second discrete portion that is overmolded around the conductors 116, 118 in a second row 128. The combination of the conductors 116, 118 and the dielectric holder 120 may represent an overmolded lead frame. The contact organizer 114 is a rigid non-conductive structure that extends along the lengths of the signal and ground conductors 116, 118 and ensures that the conductors 116, 118 are properly spaced apart from one another to prevent electrical shorts and miss-mating with the mating circuit card 106 and/or the host circuit board 104. The contact organizer 114 may define small grooves or slots that receive the conductors 116, 118 to hold the conductors 116, 118 in fixed positions. In an alternative embodiment, the electrical connector 102 has the contact organizer 114, but does not have the dielectric holder 120. For example, the conductors 116, 118 may be pressed into the small grooves along contact organizer 114 without the presence of an overmolded dielectric material. In another example of this alternative embodiment, the contact organizer 114 may be overmolded on the conductors 116, 118.

The electrical connector 102 optionally includes at least one ground tie bar 130 disposed within the outer shell 122. A first ground tie bar 130A physically engages and electrically connects to intermediate segments of the ground conductors 118 in the first row 124. A second ground tie bar 130B physically engages and electrically connects to intermediate segments of the ground conductors 118 in the second row 128. The ground tie bars 130A, 130B electrically common the ground conductors 118 of the connector 102 at intermediary locations along the lengths of the conductors 118 between the mating circuit card 106 and the host circuit board 104. The ground tie bars 130A, 130B may be electrically conductive and composed of one or more metals. Alternatively, the ground tie bars 130A, 130B may be electrically and/or magnetically lossy and configured to absorb and dissipate electrical resonances.

Figure 2:
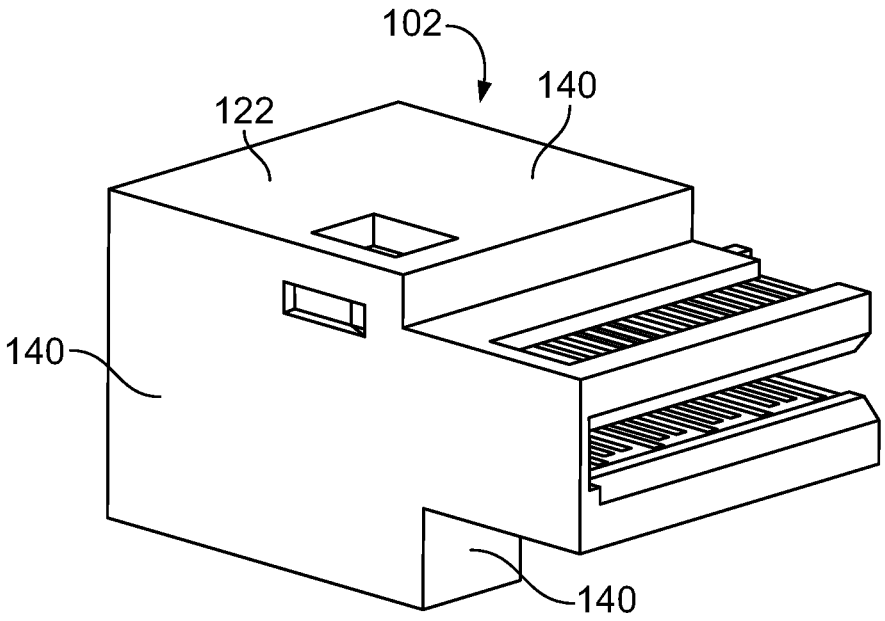
FIG. 2 is a perspective view of an electrical connector of the connector system according to an embodiment.

FIG. 2 is a perspective view of the electrical connector 102 according to an embodiment. The outer shell 122 has various walls 140 that enclose and surround the other components of the electrical connector 102. The outer shell 122 may be composed of a conductive material, such as one or more metals, or a generally non-conductive material, such as a composite or a dielectric material.

FIG. 3 is a perspective view of the electrical connector 102 shown in FIG. 2 with the outer shell 122 omitted. The contact organizer 114 has a mating end 206 and a mounting end 208. The mounting end 208 faces and may physically engage (e.g., in physical contact) the host circuit board 104 (shown in FIG. 1). The tails 126 of the signal and ground conductors 116, 118 are held at or near the mounting end 208. The signal contacts 202 and the ground contacts 204 are held proximate to the mating end 206. The contact organizer 114 may have a unitary, one-piece (e.g., monolithic) structure that extends from the mating end 206 to the mounting end 208. Alternatively, the contact organizer 114 may be an assembly of multiple discrete components, such as one component that defines the mating end 206 and holds the contacts 202, 204 and another component that defines the mounting end 208 and holds the conductors 116, 118 at or proximate to the tails 126. FIG. 3 also shows the dielectric holder 120, which may be overmolded along intermediate segments of the conductors 116, 118.

The mating end 206 of the contact organizer 114 is configured to accommodate the insertion of the mating circuit card 106. For example, the contact organizer 114 includes a first wall 210 and a second wall 212 at the mating end 206. The first and second walls 210, 212 define the card cavity 112 therebetween. The card cavity 112 is open at the mating end 206. The mating circuit card 106 (shown in FIG. 1) is received in the card cavity 112 through the opening at the mating end 206 to electrically connect the mating circuit card 106 to the electrical connector 102. In the illustrated embodiment, the first and second walls 210, 212 extend parallel to each other. The first wall 210 is referred to herein as an upper wall, and the second wall 212 is referred to as a lower wall. As used herein, relative or spatial terms such as "upper," "lower," "front," "rear," "top," and "bottom" are only used to identify and distinguish the referenced elements according to the illustrated orientations, and do not necessarily require particular positions or orientations relative to the surrounding environment of the electrical connector 102. The first or upper wall 210 has an inner surface 216 that faces towards the second or lower wall 212. The lower wall 212 has a respective inner surface 218 that faces towards the upper wall 210. The card cavity 112 is defined between the respective inner surfaces 216, 218.

The signal contacts 202 and the ground contacts 204 are held by the contact organizer 114 along at least one of the upper wall 210 or the lower wall 212. In the illustrated embodiment, the signal contacts 202 and the ground contacts 204 are arranged along both of the walls 210, 212. For example, the signal and ground contacts 202, 204 in the first row 124 (of the conductors 116, 118 shown in FIG. 1) are disposed along the upper wall 210, and the signal and ground contacts 202, 204 in the second row 128 are disposed along the lower wall 212. The signal and ground contacts 202, 204 along the upper wall 210 are configured to engage corresponding pads or other conductive elements along the first side 127 of the mating circuit card 106 (shown in FIG. 1). The signal and ground contacts 202, 204 along the lower wall 212 are configured to engage corresponding pads or other conductive elements along the second side 129 of the mating circuit card 106 (FIG. 1). The signal and ground contacts 202, 204 protrude beyond the inner surfaces 216, 218 of the walls 210, 212 into the card cavity 112, which enables the contacts 202, 204 to physically engage the corresponding pads or other conductive elements of the mating circuit card 106 as the mating circuit card 106 is inserted into the card cavity 112. In an alternative embodiment in which the contacts 202, 204 are only disposed along one of the two walls 210, 212 of the contact organizer 114, the contacts 202, 204 only engage corresponding conductive pads along one side of the mating circuit card 106.

The electrical connector 102 includes at least one absorber member 123 mounted to the contact organizer 114 at the mating end 206. In the illustrated embodiment, a first absorber member 123A of the at least one absorber member 123 is mounted to the upper wall 210 at the mating end 206, and a second absorber member 123B of the at least one absorber member 123 is mounted to the lower wall 212 at the mating end 206. Each of the first and second absorber members 123A, 123B includes at least one limb 220 (e.g., post, arm, protrusion, etc.) that projects into the card cavity 112. The first and second absorber members 123A, 123B in the illustrated embodiment each have multiple limbs 220. The limbs 220 of the first absorber member 123A project beyond the inner surface 216 of the upper wall 210 into the card cavity 112. The limbs 220 of the second absorber member 123B project beyond the inner surface 218 of the lower wall 212 into the card cavity 112. The limbs 220 of the absorber members 123A, 123B are composed of a lossy material. The lossy material absorbs electrical energy (e.g., current). For example, the limbs 220 electrically connect to ground pads 330 (shown in FIG. 5) of the mating circuit card 106 via a conductive path or an inductive path. The limbs 220 of the first absorber member 123A electrically connect to ground pads 330 on the first side 127 of the mating circuit card 106 (FIG. 1), and the limbs 220 of the second absorber member 123B electrically connect to ground pads 330 on the opposite, second side 129 of the mating circuit card 106. The absorber members 123A, 123B are used to mitigate resonances in the mating zone, which may improve signal transmission performance of the connector system 100 at high frequencies, as described in more detail herein.

Figure 4:
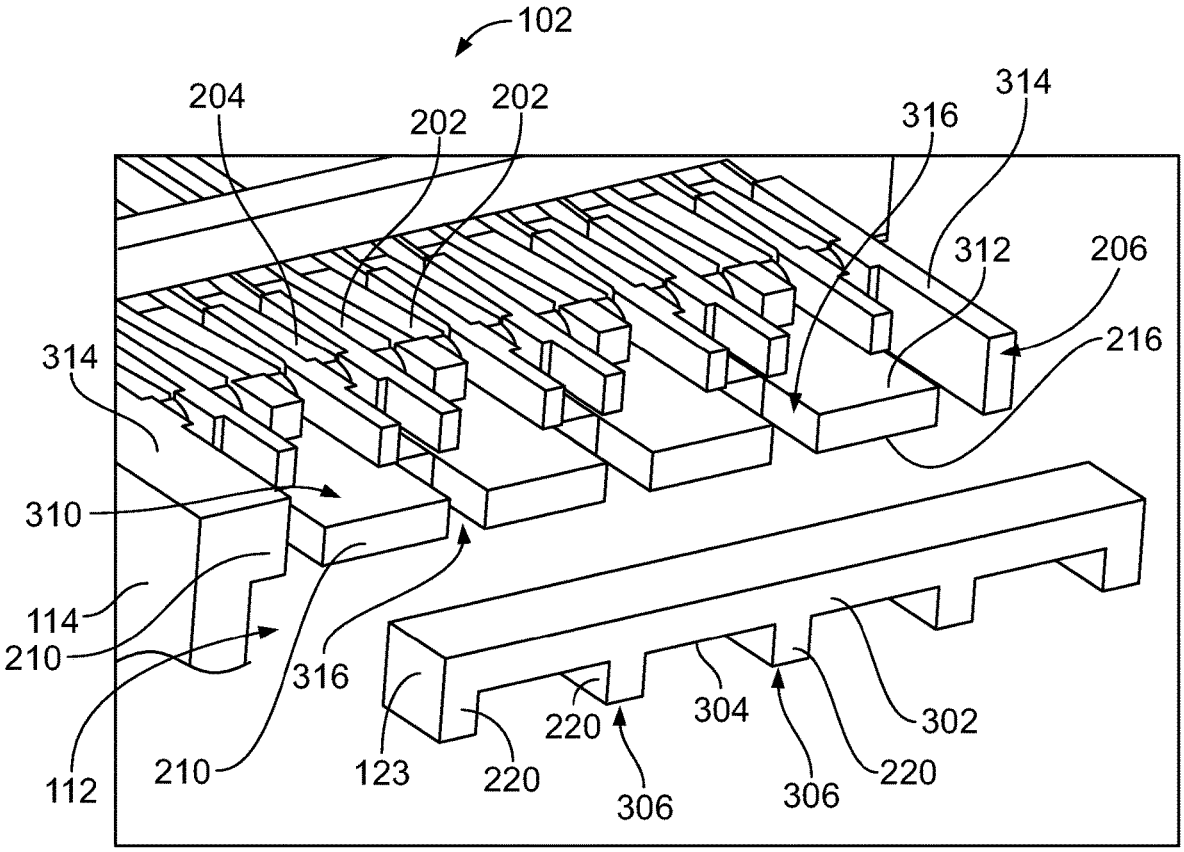
FIG. 4 is an exploded perspective view of a portion of the electrical connector according to an embodiment.

FIG. 4 is an exploded perspective view of a portion of the electrical connector 102 according to an embodiment. FIG. 4 shows an absorber member 123 unmounted and spaced apart from the upper wall 210 of the contact organizer 114 for descriptive purposes. The following description of the absorber member 123 shown in FIG. 4 may refer to either or both of the first and second absorber members 123A, 123B shown in FIG. 3. For example, the first and second absorber members 123A, 123B may be replica versions of each other, such that the two absorber members 123A, 123B have the same size, shape, and material composition. Alternatively, the first absorber member 123A may have a different size, shape, and/or material composition than the second absorber member 123B.

The absorber member 123 has an elongated crossbar 302 and multiple limbs 220 that extend from the crossbar 302. The limbs 220 are spaced apart along the length of the crossbar 302. For example, the limbs 220 may be evenly spaced apart with a uniform distance between adjacent limbs 220. The absorber member 123 has five limbs 220 in the illustrated embodiment, but may have a different number of limbs 220 in another embodiment. All of the limbs 220 extend from the same side 304 of the crossbar 302 in parallel orientations. The side 304 is referred to as a cavity-facing side 304 of the crossbar 302. The limbs 220 extend towards the card cavity 112. The limbs 220 extend from the crossbar 302 to respective distal ends 306 of the limbs 220. The limbs 220 may have uniform lengths. The crossbar 302 is shown in FIG. 4 as a rectangular block-like structure that is linear with planar sides, but the crossbar 302 may have one or more curved sides or a non-linear shape in an alternative embodiment. The limbs 220 of the absorber member 123 are physically connected to one another via the crossbar 302.

The upper wall 210 of the contact organizer 114 defines an indentation 310 that accommodates the absorber member 123. The indentation 310 extends along a lateral width of the upper wall 210 at the mating end 206. The length of the indentation 310 may represent a majority of the lateral width of the upper wall 210. For example, the indentation 310 may extend a length that is equal to or greater than a lateral width of the arrangement of signal contacts 202 and ground contacts 204 disposed side-by-side along the upper wall 210. The indentation 310 is spaced apart from the card cavity 112 by a thickness of the upper wall 210 defined between a floor surface 312 of the upper wall 210 and the inner surface 216 of the upper wall 210. The floor surface 312 represents a base of the indentation 310. Outside of the indentation 310, the upper wall 210 has a thickness from the inner surface 216 to an outer or top surface 314. The indentation 310 is a cutout portion of the upper wall 210 that is recessed from the outer surface 314. The thickness of the upper wall 210 along the indentation 310 is less than the thickness of the upper wall 210 outside of the indentation 310. The upper wall 210 may define multiple notches 316 through the upper wall 210 from the indentation 310 to the card cavity 112. The notches 316 may extend from the floor surface 312 through the inner surface 216.

In an embodiment, the absorber member 123 is mounted to the contact organizer 114 at the mating end 206 within the indentation 310. For example, the crossbar 302 is held in the indentation 310, and the limbs 220 extend into different individual notches 316. The limbs 220 may extend through the notches 316 such that the distal ends 306 of the limbs 220 project beyond the inner surface 216 into the card cavity 112. The cavity-facing side 304 of the crossbar 302 may abut (e.g., in physical contact with) the floor surface 312 of the upper wall 210. The absorber member 123 may be held in place on the contact organizer 114 via an interference fit within the indentation 310, an adhesive between contacting surfaces, a fastener, installation of another component that blocks movement of the absorber member 123 relative to the contact organizer 114, and/or the like.

In the illustrated embodiment, the crossbar 302 of the absorber member 123 is composed of a lossy material, like the limbs 220. For example, the entire absorber member 123 may be composed of a common lossy material. Due to the lossy material, the absorber member 123 has a greater electric loss tangent and/or magnetic loss tangent than the dielectric material of the contact organizer 114. For example, the lossy material of the absorber member 123 may have a greater electric loss tangent than the dielectric material of the contact organizer 114, may have a greater magnetic loss tangent than the dielectric material of the contact organizer 114, or may have both a greater electric loss tangent and a greater magnetic loss tangent than the dielectric material of the contact organizer 114. As a result, the absorber member 123 more readily absorbs and dissipates electrical energy (e.g., current) than the contact organizer 114, which mitigates resonances when the energy is absorbed along the conductive ground paths. The lossy material of the absorber member 123 is less conductive than the conductive metal material of the signal and ground conductors 116, 118 (including the signal and ground contacts 202, 204).

The lossy material of the absorber member 123 may include electrically conductive filler particles dispersed within a dielectric binder. The dielectric binder is used to hold the conductive filler particles in place and at least partially control the electrical properties of the lossy material. As used herein, the term "binder" encompasses material that encapsulates the filler or is impregnated with the filler. The binder may be any material that will set, cure, or can otherwise be used to position the filler material. In one or more embodiments, the binder is a curable thermosetting polymer, such as an epoxy, an acrylic resin, or the like.

The conductive filler particles impart loss to the lossy material. Examples of conductive particles that may be used as a filler to form electrically lossy materials include carbon or graphite formed as fibers, flakes, powders, or other particles. Metal in the form of powder, flakes, fibers, or other conductive particles may also be used as the conductive filler elements to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% or more by volume.

In some embodiments, the lossy material may simultaneously be electrically-lossy and a magnetically-lossy. For example, the lossy material may be composed of a binder material with magnetic particles dispersed therein to provide magnetic properties. Materials such as magnesium ferrite, nickel ferrite, lithium ferrite, yttrium garnet and/or aluminum garnet may be used as magnetic particles. The magnetic particles may be in the form of flakes, fibers, or the like. Such lossy materials may be formed, for example, by using magnetically-lossy filler particles that are partially conductive or by using a combination of magnetically-lossy and electrically-lossy filler particles.

The lossy absorber member 123 may be formed via molding, extruding, additively manufacturing, or the like. Various characteristics of the absorber member 123, such as the concentration of conductive filler material, the thickness of the limbs 220, the proximity of the limbs 220 to the conductive elements of the connector 102 and the mating circuit card 106, and the like, may be controlled to tune the electrical absorption properties of the absorber member 123. For example, the characteristics of the absorber member 123 may be selected to provide a desired amount of electrical energy absorption and dissipation, while also limiting signal degradation attributable to insertion loss caused by the absorber member 123. The characteristics may be selected such that the absorber members 123 absorb electrical resonances at high frequencies, such as frequencies above 20 GHz. In a non-limiting example embodiment, the absorber members 123 are configured to absorb electrical resonances at frequencies above 30 GHz.

Although FIG. 4 only shows the upper wall 210, the lower wall 212 may have an indentation that mirrors the indentation 310 of the upper wall 210. The absorber member 123B mounts to the lower wall 212 within the indentation of the lower wall 212 in the same way as described above with reference to the upper wall 210.

Figure 5:
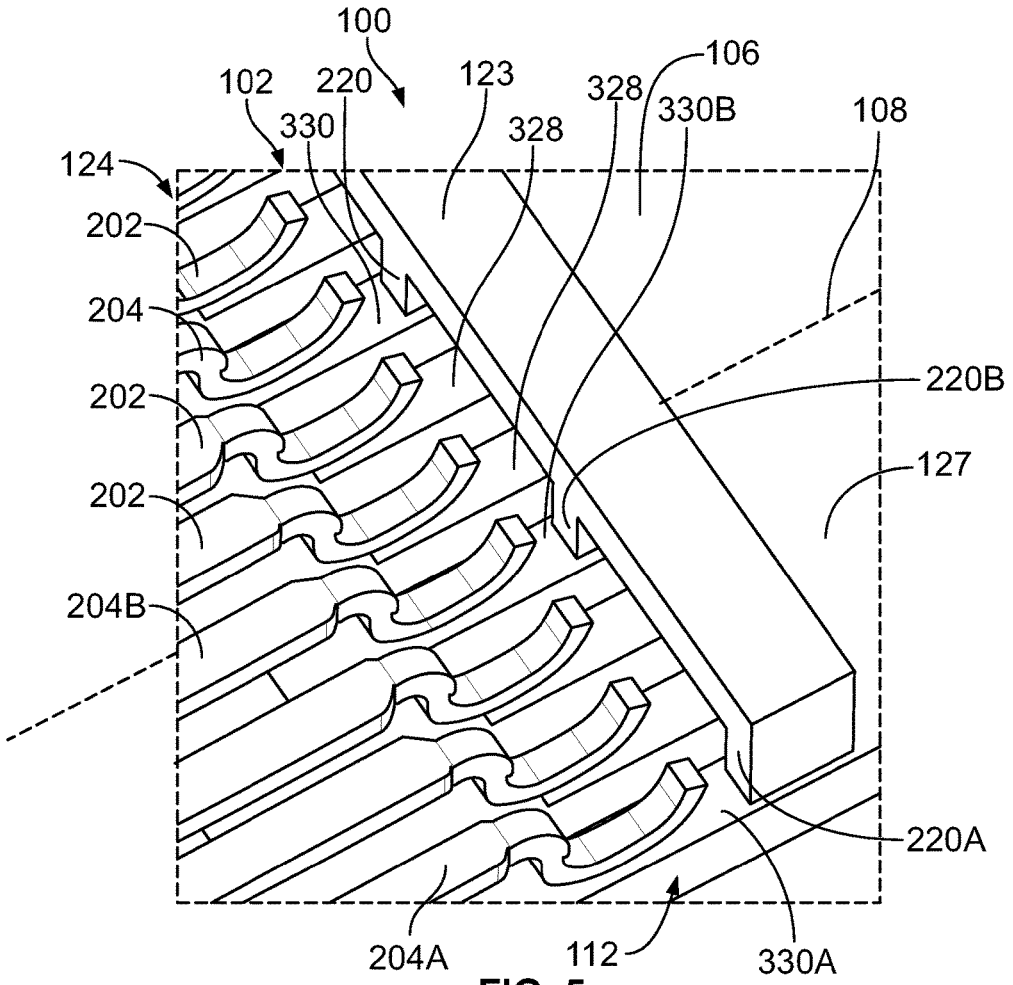
FIG. 5 is a perspective view of a portion of the connector system showing a mating circuit card loaded into a card cavity of the electrical connector.

FIG. 5 is a perspective view of a portion of the connector system 100 showing the mating circuit card 106 loaded into the card cavity 112 of the electrical connector 102. The contact organizer 114 is omitted in FIG. 5 to show the signal contacts 202, the ground contacts 204, and the absorber member 123 of the electrical connector 102 in detail. When the mating circuit card 106 is received within the card cavity 112, the signal contacts 202 of the electrical connector 102 physically engage and electrically connect to corresponding signal pads 328 of the mating circuit card 106, and the ground contacts 204 of the electrical connector 102 physically engage and electrically connect to corresponding ground pads 330 of the mating circuit card 106 to establish conductive pathways across the mating interface.

FIG. 5 only shows one the signal and ground contacts 202, 204 arranged in one row, such as the row 124 that is disposed along the upper wall 210 (shown in FIG. 3) of the contact organizer 114. The signal contacts 202 and ground contacts 204 in the row 124 are interspersed across the lateral width of the row 124. The signal and ground contacts 202, 204 may be arranged in a repeating sequence or pattern. In an embodiment, the signal contacts 202 are arranged in pairs. Each pair of signal contacts 202 may define a differential pair that is configured to convey complementary differential signals. Each pair of signal contacts 202 may be separated from a nearest pair of the signal contacts 202 by at least one of the ground contacts 204. Thus, adjacent pairs of the signal contacts 202 are separated by at least one ground contact 204. In the illustrated embodiment, the signal and ground contacts 202, 204 are interspersed in a repeating ground-signal-signal-ground-signal-signal pattern. The contacts 202, 204 in the other row 128 (shown in FIG. 3) may have the same repeating pattern as the contacts 202, 204 in the row 124, or may have a different pattern. In addition, the types, sizes, and/or shapes of the contacts 202, 204 in the first row 124 optionally may differ from the types, sizes, and/or shapes of at least some of the contacts 202, 204 in the second row 128. For example, the first row 124 may include high speed contacts, while the second row 128 includes non-high speed, auxiliary contacts used to transmit power and/or data signals.

The signal pads 328 and the ground pads 330 of the mating circuit card 106 may be arranged in a repeating sequence or pattern that mirrors the repeating sequence of the signal and ground contacts 202, 204 of the electrical connector 102. For example, the signal pads 328 and the ground pads 330 along the first side 127 of the mating circuit card 106 shown in FIG. 5 may be arranged in a ground-signal-signal-ground-signal-signal pattern. As the mating circuit card 106 is loaded into the card cavity 112 along the mating axis 108, the signal pads 328 align with corresponding signal contacts 202 and the ground pads 330 align with corresponding ground contacts 204.

The absorber member 123 is mounted to the contact organizer 114 (shown in FIG. 3) such that each of the limbs 220 of the absorber member 123 aligns with a corresponding one of the ground contacts 204 of the electrical connector 102. For example, the limb 220A at the end of the absorber member 123 aligns with the ground contact 204A at the end of the row 124. The limb 220B adjacent to the end limb 220A aligns with the ground contact 204B that is adjacent to the end ground contact 204A. In the illustrated embodiment, each of the limbs 220 is axially spaced apart along the mating axis 108 from the corresponding ground contact 204 that aligns with the particular limb 220. In the illustrated embodiment, the limbs 220 of the absorber member 123 do not physically engage the ground contacts 204 of the electrical connector 102. Although the mating end 206 (shown in FIG. 3) of the contact organizer 114 is not shown in FIG. 5, the limbs 220 are disposed closer to the mating end 206 than the ground contacts 204.

The limbs 220 of the absorber member 123 are configured to electrically connect to the ground pads 330 of the mating circuit card 106 when the mating circuit card 106 is received in the card cavity 112. The limbs 220 electrically connect to different corresponding ground pads 330 of the mating circuit card 106. For example, the end limb 220A electrically connects to the ground pad 330A at the end of the mating circuit card 106, and the limb 220B adjacent to the end limb 220A electrically connects to the ground pad 330B adjacent to the end ground pad 330A. In an embodiment, the limbs 220 may electrically connect to the ground pads 330 via direct physical engagement to define a conductive pathway therebetween. In an alternative embodiment, the limbs 220 electrically connect to the ground pads 330 via an indirect inductive pathway without physical engagement. For example, the limbs 220 may extend within a threshold proximity distance of the ground pads 330 to enable an inductive electrical connection therebetween, which allows the limbs 220 to absorb and dissipate electrical resonances along the ground pads 330.

Figure 6:
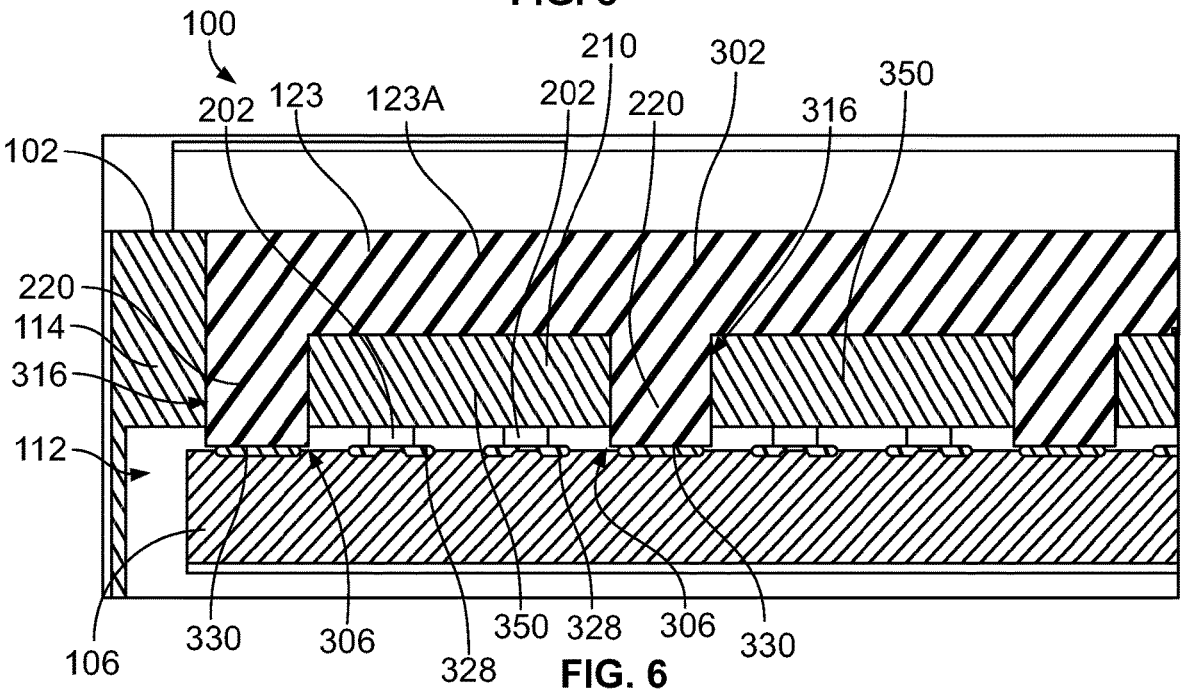
FIG. 6 is an end cross-sectional view of the connector system showing the mating circuit card loaded in the card cavity of the electrical connector according to an embodiment.

FIG. 6 is an end cross-sectional view of the connector system 100 showing the mating circuit card 106 loaded in the card cavity 112 of the electrical connector 102 according to an embodiment. The cross-section is taken along a line that extends through the first absorber member 123A, the upper wall 210 of the contact organizer 114, and the mating circuit card 106. The distal ends 306 of the limbs 220 of the absorber member 123A project beyond the inner surface 216 of the upper wall 210 and into the card cavity 112. The distal ends 306 abut against and physically engage the corresponding ground pads 330 of the mating circuit card 106. Because the limbs 220 are composed of a lossy material, the limbs 220 are configured to absorb and dissipate electrical resonance (e.g., resonating currents) from the ground pads 330. Absorbing the electrical resonance may reduce electromagnetic interference in the mating zone, which improves signal transmission quality, especially at high transfer speeds. For example, the absorber members 123 may reduce electrical resonances at frequencies at or above 20 GHz, such as 30 GHz, 35 GHz, 40 GHz, and the like.

In an embodiment, the absorber member 123A is spaced apart from the signal pads 328 of the mating circuit card 106 while the mating circuit card 106 is disposed within the card cavity 112. For example, the signal pads 328 are located between the limbs 220 along the lateral width. The lossy material of the crossbar 302 of the absorber member 123A is spaced apart from the signal pads 328 by the segments 350 of the upper wall 210 located between the notches 316. The lossy material of the absorber member 123A may be located a sufficient distance from the signal pads 328 (and the signal contacts 202 of the electrical connector 102) to prevent a significant increase in insertion loss along the signal conductive pathways. For example, the presence of the absorber members 123 may have a negligible effect on insertion loss, while desirably providing resonance damping.

Figure 7:
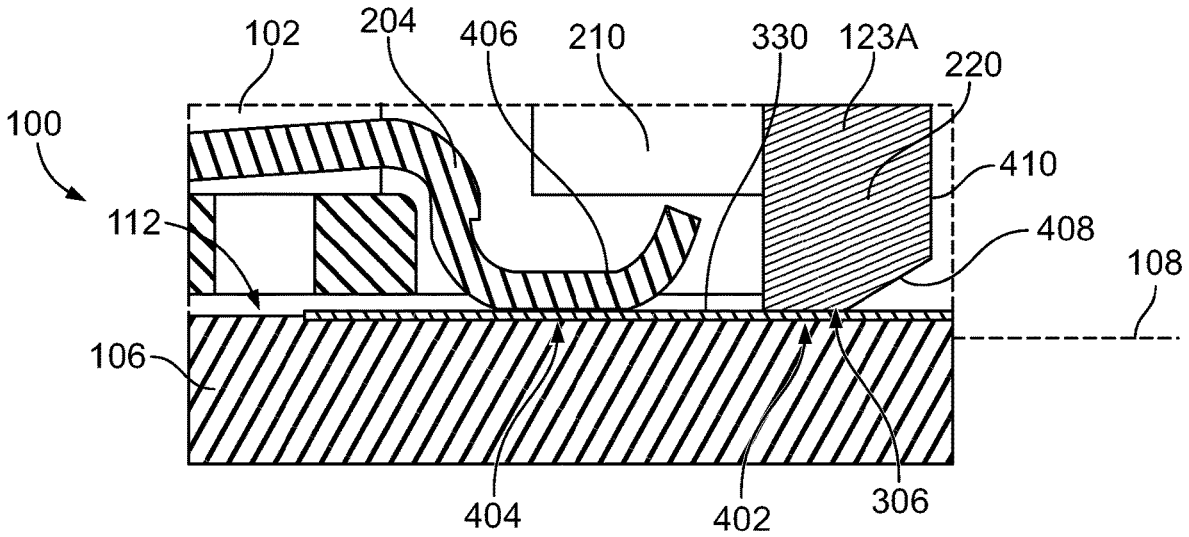
FIG. 7 is a side cross-sectional view of a portion of the connector system with the mating circuit card loaded in the card cavity of the electrical connector according to an embodiment.

FIG. 7 is a side cross-sectional view of a portion of the connector system 100 with the mating circuit card 106 loaded in the card cavity 112 of the electrical connector 102 according to an embodiment. The cross-section is taken along a line that is perpendicular to the cross-section line shown in FIG. 6. The line extends through a limb 220 of the first absorber member 123A, a ground contact 204 of the electrical connector 102 that aligns with the limb 220, and a ground pad 330 of the mating circuit card 106 that aligns with both the limb 220 and the ground contact 204. In the illustrated embodiment, when the mating circuit card 106 is loaded into the card cavity 112, the distal end 306 of the limb 220 physically engages a surface (e.g., top surface) of the ground pad 330 to define a first connection point 402. The ground pad 330 is elongated parallel to the mating axis 108. The ground contact 204, which is longitudinally offset from the limb 220, physically engages the surface of the ground pad 330 to define a second connection point 404. Thus, the same ground pad 330 physically engages both the limb 220 and the ground contact 204 at two different (e.g., spaced apart) connection points 402, 404.

The ground contact 204 may be a deflectable spring beam with a curved engagement section 406 to prevent stubbing on the mating circuit card 106. In an embodiment, the distal end 306 of the limb 220 has an angled lead-in surface 408 to reduce stubbing on the mating circuit card 106 while the mating circuit card 106 is loaded into the card cavity 112.

The angled lead-in surface 408 may be a ramp that extends from the distal end 306 to a front side 410 of the absorber member 123A.

Optionally, the limbs 220 of the absorber member 123A may be at least partially deflectable or compressible such that the distal end 306 retracts towards the upper wall 210 due to forces exerted on the distal end 306 by the mating circuit card 106. For example, as the mating circuit card 106 is moved into the card cavity 112 along the mating axis 108, the ground pad 330 may abut the distal end 306 of the limb 220 and force the limb 220 to compress and/or deflect in a direction away from the card cavity 112 (e.g., towards the upper wall 210) to allow for insertion of the mating circuit card 106. The limbs 220 may be compressible due to material properties of the absorber member 123A, such that some binder materials of the lossy material are at least partially compressible. Alternatively, the limbs 220 may be constructed into a deflectable beam shape that enables the limbs 220 to deflect away from the card cavity 112 towards the upper wall 210 when forced by the mating circuit card 106.

Figure 8:
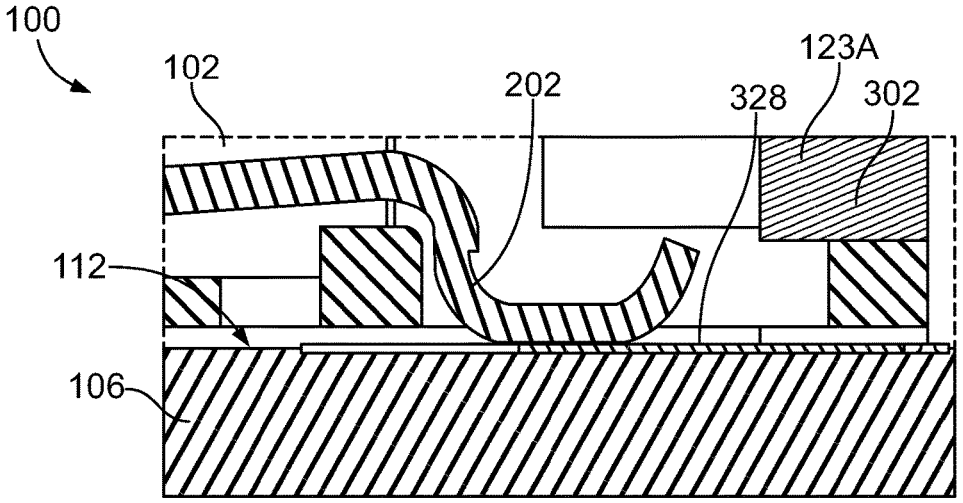
FIG. 8 is another side cross-sectional view of a portion of the connector system with the mating circuit card loaded in the card cavity of the electrical connector according to an embodiment.

FIG. 8 is another side cross-sectional view of a portion of the connector system 100 with the mating circuit card 106 loaded in the card cavity 112 of the electrical connector 102 according to an embodiment. The cross-section in FIG. 8 is taken along a line that is parallel to the cross-section line of FIG. 7. The line extends through the crossbar 302 of the first absorber member 123A, a signal contact 202 of the electrical connector 102, and a signal pad 328 of the mating circuit card 106 that aligns with the signal contact 202. When the mating circuit card 106 is loaded in the card cavity 112, the signal contact 202, which is longitudinally offset from the crossbar 302, physically engages a surface of the signal pad 328 to establish a conductive connection. The absorber member 123A is spaced apart from the signal pad 328 and the signal contact 202. For example, the crossbar 302 of the absorber member 123A is suspended above the signal pad 328 without engaging the signal pad 328.

Figure 9:
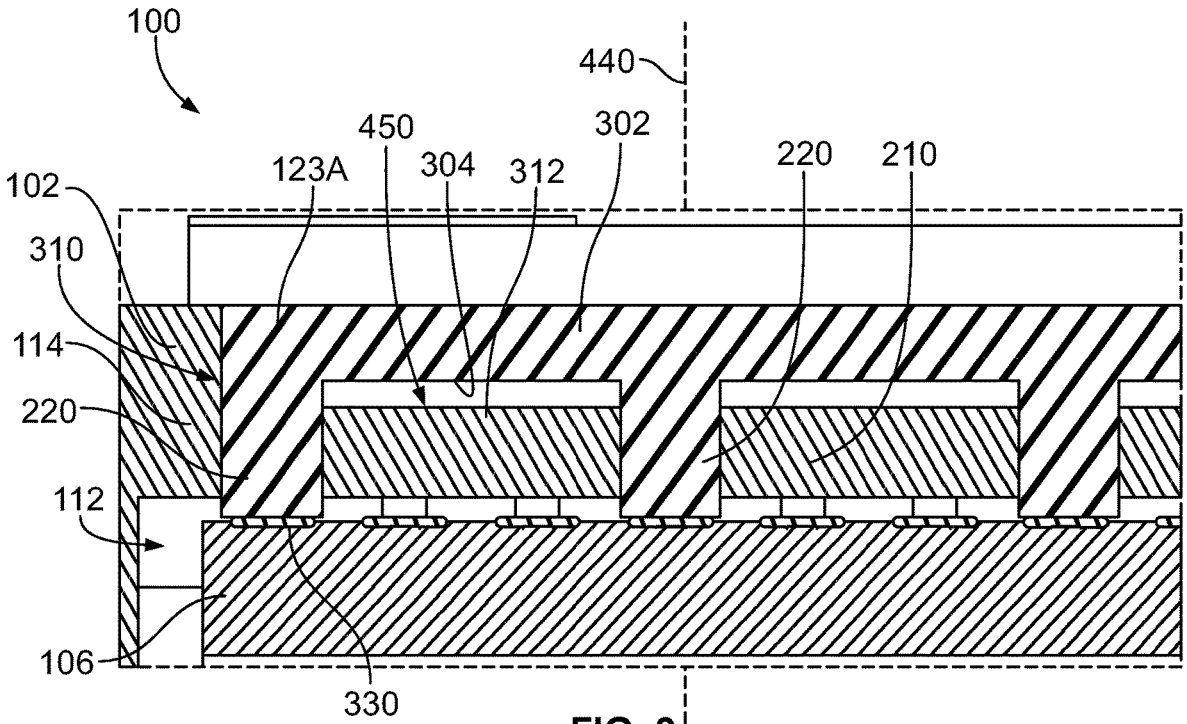
FIG. 9 is a cross-sectional view of the connector system showing the mating circuit card loaded in the card cavity of the electrical connector according to an alternative embodiment.

FIG. 9 is a cross-sectional view of the connector system 100 showing the mating circuit card 106 loaded in the card cavity 112 of the electrical connector 102 according to an alternative embodiment. The illustrated embodiment differs from the embodiment shown in FIG. 6 because the absorber member 123A is mounted to the contact organizer 114 such that the absorber member 123A is able to float along an elevation axis 440 relative to the contact organizer 114. For example, the crossbar 302 is able to separate from the floor surface 312 of the upper wall 210 within the indentation 310 and float within a designated clearance distance from the floor surface 312 without unmounting or disconnecting from the contact organizer 114. The absorber member 123A may be biased towards an extended position in which the crossbar 302 abuts against the floor surface 312. In the extended position, the limbs 220 project farther into the card cavity 112 than when the absorber member 123A is in a retracted position.

When the mating circuit card 106 is received in the card cavity 112, the ground pads 330 of the mating circuit card 106 may physically engage the limbs 220 of the absorber member 123A and force the absorber member 123A to transition from the extended position to a retracted position. In the retracted position, the crossbar 302 is separated from the floor surface 312 and the limbs 220 do not extend as far into the card cavity 112 as in the extended position. In FIG. 9, the absorber member 123A is shown in the retracted position, such that there is an air gap 450 between the floor surface 312 and the cavity-facing side 304 of the crossbar 302. The float of the absorber member 123A may reduce stubbing and ensure that the limbs 220 maintain physical engagement with the ground pads 330 of the mating circuit card 106 while the mating circuit card 106 is within the card cavity 112. The absorber member 123A may return to the extended position upon the removal of the mating circuit card 106 from the card cavity 112. Although FIG. 9 only shows the first absorber member 123A on the upper wall 210, the second absorber member 123B may be floatable relative to the lower wall 212 in the same way.

Figure 10:
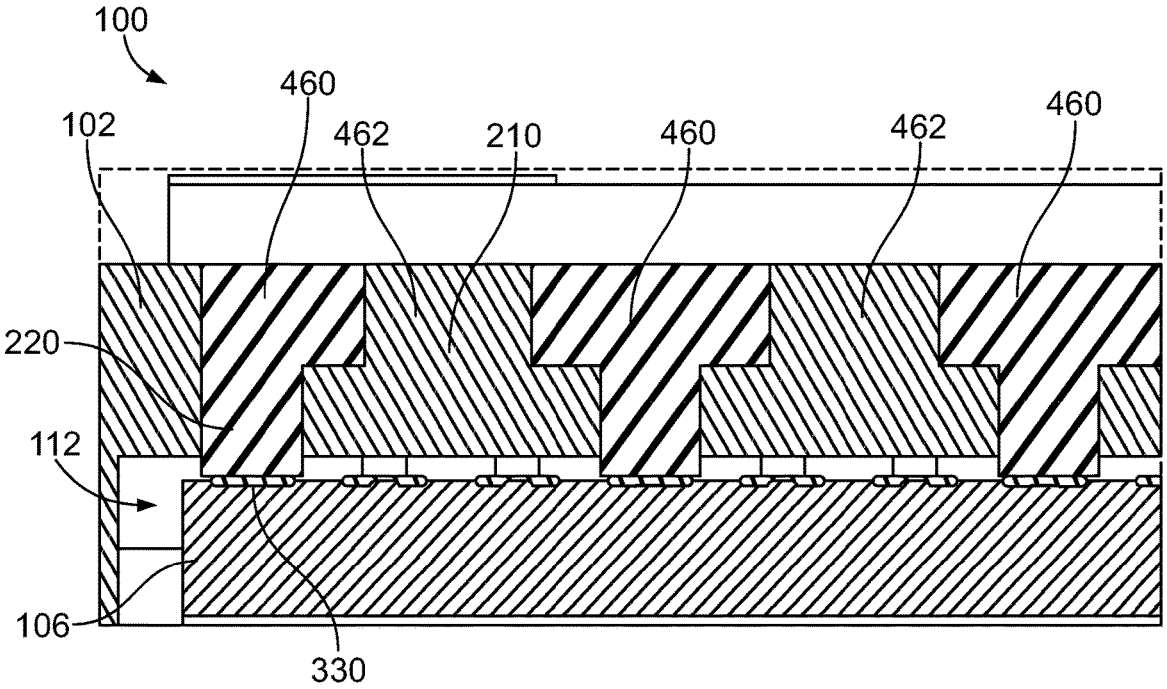
FIG. 10 is a cross-sectional view of the connector system showing the mating circuit card loaded in the card cavity of the electrical connector according to another alternative embodiment.

FIG. 10 is a cross-sectional view of the connector system 100 showing the mating circuit card 106 loaded in the card cavity 112 of the electrical connector 102 according to another alternative embodiment. The illustrated embodiment differs from previously-disclosed embodiments because the electrical connector 102 includes multiple absorber members 460 mounted to the upper wall 210 instead of a single absorber member 123A. The absorber members 460 may be composed of a lossy material like the absorber members 123A, 123B, such that the absorber members 460 are configured to mitigate and dampen resonances along the ground pathways, especially at high frequencies, such as at or above 20 GHz. For example, each of the absorber members 460 includes one limb 220 in FIG. 10. Each limb 220 electrically connects to a different corresponding ground pad 330 such that each absorber member 460 absorbs resonances along a different ground path. The absorber members 460 are mounted adjacent to one another across the lateral width of the upper wall 210. The absorber member 460 may be spaced apart by intervening segments 462 of the upper wall 210, and may be individually mounted onto the upper wall 210.

Various embodiments of the connector system 100 described herein include one or more absorber members mounted to an electrical connector at a mating end thereof. The absorber member is composed of a lossy material that is configured to mitigate resonances in the mating zone. The absorber member may be spaced apart from the contacts of the electrical connector on which the absorber member is mounted, but may be configured to physically engage, or at least electrically connect to, the ground pads of the mating circuit card that is received within a card cavity of the electrical connector. The absorber member may absorb and dissipate resonances at relatively high frequency ranges, such as above 20 GHz. For example, experimental testing with an embodiment of the connector system 100 has yielded results indicating significant dampening of electrical resonances at frequencies between about 30 GHz and about 45 GHz, relative to similar connector systems that lack the one or more absorber members described herein. These high frequency resonances that are dampened by the absorber member may be attributable to spacing between vias along the mating circuit card. The experimental testing also indicated no significant or noticeable increase in insertion loss along the signal pathways attributable to the presence of the lossy absorber member.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a contact organizer having a mating end, the contact organizer including a first wall and a second wall that define a card cavity between respective inner surfaces of the first and second walls, the card cavity open at the mating end to receive a mating circuit card therein;

signal contacts and ground contacts held by the contact organizer along at least the first wall; and an absorber member mounted to the first wall of the contact organizer at the mating end, the absorber member including at least one limb composed of a lossy material, wherein each limb of the at least one limb projects beyond the inner surface of the first wall into the card cavity and aligns with a corresponding one of the ground contacts, wherein each limb is configured to electrically connect to a corresponding ground pad of the mating circuit card.

2. The electrical connector of claim 1, wherein each limb is configured to physically engage the corresponding ground pad of the mating circuit card to define a first connection point that is axially spaced apart from a second connection point defined by physical engagement between the same ground pad and the ground contact that aligns with the limb.

3. The electrical connector of claim 1, wherein each limb is axially spaced apart along a mating axis from the corresponding ground contact that aligns with the limb such that the limb is located closer to the mating end of the contact organizer than the corresponding ground contact.

4. The electrical connector of claim 1, wherein the absorber member includes a crossbar that is composed of the lossy material and extends a length along the first wall, wherein the at least one limb of the absorber member includes multiple limbs that extend from the crossbar at spaced apart locations along the length of the crossbar, the multiple limbs configured to electrically connect to different corresponding ground pads of the mating circuit card.

5. The electrical connector of claim 4, wherein the contact organizer defines an indentation along a lateral width of the first wall at the mating end, the indentation spaced apart from the inner surface of the first wall via a thickness of the first wall, the first wall defining multiple notches through the first wall from the indentation to the card cavity, wherein the absorber member is mounted to the contact organizer such that the crossbar is held within the indentation and the limbs extend through the notches into the card cavity.

6. The electrical connector of claim 1, wherein the absorber member is longitudinally spaced apart from the signal conductors and the ground conductors in the array, and wherein the absorber member is spaced apart from signal pads of the mating circuit card while the mating circuit card is disposed within the card cavity.

7. The electrical connector of claim 1, wherein the absorber member is a first absorber member and the electrical connector further comprises a second absorber member that is mounted to the second wall of the contact organizer at the mating end, the second absorber member including at least one limb composed of a lossy material, wherein each limb of the second absorber member projects beyond the inner surface of the second wall into the card cavity and is configured to electrically connect to a corresponding ground pad of the mating circuit card.

8. The electrical connector of claim 1, wherein the absorber member is a first absorber member and the electrical connector further comprises a second absorber member that is mounted to the first wall of the contact organized adjacent to the first absorber member, the second absorber member including at least one limb composed of a lossy material, wherein each limb of the second absorber member projects beyond the inner surface of the first wall into the card cavity and aligns with a corresponding one of the ground contacts, wherein the at least one limb of the first absorber member and the at least one limb of the second absorber member align with different ground contacts and are configured to electrically connect to different ground pads of the mating circuit card.

9. The electrical connector of claim 1, wherein the absorber member absorbs electrical resonance at frequencies above 30 GHz.

10. The electrical connector of claim 1, wherein the lossy material of the absorber member has a greater electric loss tangent or magnetic loss tangent than the contact organizer.

11. The electrical connector of claim 1, wherein the lossy material of the absorber member includes electrically conductive filler particles dispersed within a dielectric binder.

12. The electrical connector of claim 1, wherein a distal end of each limb has an angled lead-in surface to reduce stubbing on the mating circuit card while the mating circuit card is inserted into the card cavity.

13. The electrical connector of claim 1, wherein each limb of the absorber member is at least partially deflectable or compressible such that a distal end of the limb retracts toward the first wall due to forces exerted on the distal end by the corresponding ground pad of the mating circuit card while the mating circuit card is inserted into the card cavity.

14. An electrical connector comprising:

a contact organizer having a mating end, the contact organizer including a first wall and a second wall that define a card cavity between respective inner surfaces of the first and second walls, the card cavity open at the mating end to receive a mating circuit card therein;

signal contacts and ground contacts held by the contact organizer along at least the first wall; and an absorber member mounted to the first wall of the contact organizer at the mating end, the absorber member composed of a lossy material having a greater electric loss tangent or magnetic loss tangent than the contact organizer, the absorber member including a crossbar that extends a length along the first wall and multiple limbs that extend from the crossbar at spaced apart locations along the length thereof, wherein each limb of the multiple limbs projects beyond the inner surface of the first wall into the card cavity and aligns with a corresponding one of the ground contacts, the multiple limbs configured to electrically connect to different corresponding ground pads of the mating circuit card when the mating circuit card is received within the card cavity.

15. The electrical connector of claim 14, wherein the contact organizer defines an indentation along a lateral width of the first wall at the mating end, the indentation spaced apart from the inner surface of the first wall via a thickness of the first wall, the first wall defining multiple notches through the first wall from the indentation to the card cavity, wherein the absorber member is mounted to the contact organizer such that the crossbar is held within the indentation and the limbs extend through the notches into the card cavity.

16. The electrical connector of claim 15, wherein the absorber member is mounted to the contact organizer such that the crossbar is able to float within a designated clearance distance from a floor surface of the indentation, wherein the ground pads of the mating circuit card engage the multiple limbs of the absorber member when the mating circuit card is received within the card cavity and force the absorber member to a retracted position in which the crossbar is separated from the floor surface of the indentation.

17. The electrical connector of claim 14, wherein each limb of the multiple limbs is configured to physically engage a corresponding ground pad of the mating circuit card to define a first connection point that is axially spaced apart from a second connection point defined by physical engagement between the same ground pad and the ground contact that aligns with the limb.

18. The electrical connector of claim 14, wherein a distal end of each limb has an angled lead-in surface to reduce stubbing on the mating circuit card while the mating circuit card is inserted into the card cavity.

19. The electrical connector of claim 14, wherein each limb of the absorber member is at least partially deflectable or compressible such that a distal end of the limb retracts toward the first wall due to forces exerted on the distal end by the corresponding ground pad of the mating circuit card while the mating circuit card is received into the card cavity.

20. An electrical connector comprising:

a contact organizer extending along a mating axis from a mating end to a back end, the contact organizer including a first wall and a second wall that define a card cavity between respective inner surfaces of the first and second walls, the card cavity open at the mating end to receive a mating circuit card therein;

signal contacts and ground contacts held by the contact organizer along both the first wall and the second wall, the signal contacts being arranged in pairs, adjacent pairs of the signal contacts separated from each other by at least one of the ground contacts;

a first absorber member mounted to the first wall of the contact organizer at the mating end; and a second absorber member mounted to the second wall of the contact organizer at the mating end, wherein the first and second absorber members are composed of a lossy material, each of the first and second absorber members including at least one limb that projects into the card cavity and aligns with a corresponding one of the ground contacts, wherein each limb of the first and second absorber members is axially spaced apart along the mating axis from the corresponding ground contact that aligns with the limb such that the limb is located closer to the mating end of the contact organizer than the corresponding ground contact, wherein each limb of the first and second absorber members is configured to physically engage and electrically connect to a corresponding ground pad of the mating circuit card when the mating circuit card is received within the card cavity to define a first connection point which is axially spaced apart from a second connection point defined by physical engagement between the same ground pad and the corresponding ground contact that aligns with the limb.

* * * * *